US006055006A

United States Patent [19]

Murano

[11] Patent Number: 6,055,006

[45] Date of Patent: Apr. 25, 2000

[54] IMAGE FORMING APPARATUS HAVING EASILY ALIGNED LIGHT EMITTING ELEMENT ARRAYS

[75] Inventor: Shunji Murano, Soraku-gun, Japan

[73] Assignee: Kyocera Corporation, Kyoto, Japan

[21] Appl. No.: 08/996,004

[22] Filed: Dec. 22, 1997

[30] Foreign Application Priority Data

Dec. 27, 1996 [JP] Japan ..... 8-351598
Feb. 28, 1997 [JP] Japan ..... 9-046795

[51] Int. Cl.[7] ..... B41J 2/385; B41J 2/41

[52] U.S. Cl. ..... 347/118; 347/138; 347/152

[58] Field of Search ..... 347/118, 119, 347/142, 145, 238, 245, 152, 138; 358/296, 298

[56] References Cited

U.S. PATENT DOCUMENTS

| | | | |
|---|---|---|---|
| 4,587,717 | 5/1986 | Daniele et al. | 438/21 |
| 4,907,034 | 3/1990 | Doi et al. | 347/238 |
| 5,173,759 | 12/1992 | Murano | 257/88 |
| 5,719,680 | 2/1998 | Yoshida et al. | 358/296 |

FOREIGN PATENT DOCUMENTS

| | | | |
|---|---|---|---|
| 5396838 | 8/1978 | Japan | G03G 13/01 |
| 5844445 | 3/1983 | Japan | G03G 13/00 |
| 1306880 | 12/1989 | Japan | G03G 15/10 |

*Primary Examiner*—N. Le
*Assistant Examiner*—Thinh Nguyen
*Attorney, Agent, or Firm*—Loeb & Loeb LLP

[57] ABSTRACT

The object of the invention is to provide a small-size image forming apparatus in which a plurality of light emitting element arrays are easily aligned with each other at high accuracy. Each of light emitting element arrays of Y, M, C, K comprises a plurality of LED elements arranged in a straight line and is driven by a color image signal of each color. On the reference plate disposed on the support are arranged head substrates having light emitting element arrays of each color in such a manner that the light emitting element arrays are nearly in parallel with each other. On a peripheral surface of each photosensitive drum, an electrostatic latent image forming position is established where an electrostatic image is formed by receiving light from each of the light emitting element arrays, and toner of the specified color is supplied to the specified electrostatic latent image forming apparatus by each developing device. In this kind of image forming apparatus, by mounting the fight emitting element arrays on the reference plate, the light emitting element arrays can be easily aligned with each other at high accuracy. In addition, by adjusting the screwing degree of the screw member formed in the reference plate into the screw hole formed in the support, the light irradiation angle of the light emitting element arrays to the photosensitive drums can be easily changed.

6 Claims, 10 Drawing Sheets

IMAGE FORMING APPARATUS HAVING EASILY ALIGNED LIGHT EMITTING ELEMENT ARRAYS

BACKGROUND OF THE INVENTION

1. Field of the Invention

The present invention relates to an image forming apparatus for forming a color image by driving to cause a plurality of light emitting element arrays to emit light on the basis of color image signals.

2. Description of the Related Art

An example of a system to form color images in the image forming apparatus is a tandem system which provides comparatively high image forming speed. The system is driven specifically by image signals, has components for executing a single-color image forming operation, including a light emitting element array which possesses light emitting elements such as a plurality of LED (light emitting diode) elements, a photosensitive element which receives light from the light emitting element array, a developing device for developing electrostatic latent images formed on the photosensitive element exposed to light from the light emitting element array, a transferring device for transferring a toner image formed by the development onto a specified recording paper, arranged for each color image signal of, for example, yellow (Y), magenta (M), cyan (C) and black (K), respectively, and repeatedly executes operations of formation of electrostatic latent images to at least transfer for each color. An example of the relevant systems is disclosed in Japanese Unexamined Patent Publication JP-A 53-96838 (1978). In addition to this, examples using a single photosensitive element are disclosed in Japanese Unexamined Patent Publication JP-A 58-44445 (1983) and JP-A 1-306880(1989).

The image forming apparatus adopting the tandem system comprises comparatively many components, and in order to obtain highly detailed color images, light emitting element arrays themselves or light emitting element array of the same color and each element such as photo-sensitive element must be positioned highly accurately. For example, when one pixel measures approximately 100 $\mu$m by 100 $\mu$m, each element is positioned so that the positional accuracy of the pixel achieves within ±30 $\mu$m. However, highly sophisticated techniques are required to carry out this kind of positioning accurately, and this will result in marked rise in the cost of the apparatus, and the large number of components required increases the size of the apparatus.

In addition, the light emitting element array specifically comprises a plurality of LED array chips, and the relevant LED array chips comprise a specified number of light emitting elements, for example, 64 light emitting elements, and LED array chips are chosen from all LED array chips, for example, one by one, and driven in a time-sharing manner to form color images. For example, when four light emitting element arrays are used to obtain four-color images, since the respective light emitting element array are formed on separate substrates, the circuit for choosing the LED array chip is formed on each substrate. That is a cause of upsized apparatus. In addition, it is relatively complicated to control time-sharing drive by the four chosen circuits.

SUMMARY OF THE INVENTION

It is an object of the invention to provide an image forming apparatus in which a plurality of light emitting arrays are easily aligned at high accuracy, and to provide a small-size image forming apparatus in which light emission from light emitting element arrays can be easily controlled.

The invention provides an image forming apparatus comprising:

N light emitting element arrays (N is a natural number of 2 or more) each composed of a plurality of light emitting elements arranged in a straight line; and N photo-sensitive elements which receive light from each of the light emitting element arrays and on which electrostatic latent images are formed, wherein the N light emitting element arrays are mounted on one substrate at specified intervals in parallel with each other.

According to the invention, since the N light emitting element arrays are arranged on one single substrate, it is possible to easily align the light emitting element arrays with each other at high accuracy. Consequently, it is possible to simplify a positional adjustment operation. In addition, commercial productivity can be improved by the use of a single substrate on which the N light emitting element arrays are mounted.

In the invention it is preferable that a surface of the substrate on which the light emitting element arrays are mounted is curved.

According to the invention, since N light emitting element arrays are mounted on one single substrate with a curved surface, namely, having a circular arc form in cross section, it is possible to easily align all the light emitting element arrays with each other at high accuracy, whereby the positional adjustment operation is simplified. In addition, by arranging N photosensitive elements along the curved substrate surface, it is possible to downsize the image forming apparatus as a whole.

The invention provides an image forming apparatus comprising:

a photosensitive drum formed by covering a photosensitive layer around a peripheral surface of a transparent cylinder;

N light emitting element arrays (N is a natural number of 2 or more) arranged inside the photosensitive drum and each composed of a plurality of light emitting elements arranged in a straight line; and N developing devices for supplying color toner to the peripheral surface of the photosensitive drum, wherein the light emitting element arrays are mounted on one single substrate having a curved surface at specified intervals in parallel with each other, and the developing devices are disposed so that the color toner is supplied to positions of the photosensitive drum to which lights from the light emitting element arrays reach.

According to the invention, since N light emitting element arrays are mounted on one single substrate, it is possible to simplify the positional adjustment operation. Since N light emitting element arrays are mounted on one single substrate having a curved surface, which is disposed inside the photosensitive drum, it is possible to realize a small-sized image forming apparatus by arranging N developing devices around the photosensitive drum.

In the invention it is preferable that the light emitting elements of each of the N light emitting element arrays are classified into K groups (K is a natural number); a group selecting circuit for selecting one from among the groups of light emitting elements of each light emitting element array in the time-sharing manner, and K pieces of group selecting wiring are disposed on the substrate; and the light emitting elements of the N light emitting element arrays are connected in common by group via the K pieces of group selecting wiring.

According to the invention, since the N light emitting element arrays are mounted on one single substrate, it is possible to provide a group selecting circuit in common to select the light emitting elements of the N light-element arrays simultaneously by group. Consequently, the size of the apparatus can be reduced. In the prior art, group selecting circuits, for example, for four colors, are necessary, and therefore the control of light emitting element selection is complicated, whereas in the invention it is possible to easily control light emission of each light emitting element array by one group selecting circuit at the same time.

The present Invention provides an image forming apparatus comprising:

exposing means having N head substrates (N is a natural number of 2 or more) mounted on a reference plate disposed on a support and provided with light emitting element arrays, the exposing means being mounted on the reference plate so that the light emitting element arrays are aligned nearly in parallel with each other; and N photosensitive elements on which electrostatic latent images are formed by receiving light from each light emitting element of the exposing means, wherein screw holes are provided on the support and as well screw members for screwing into the screw hole are formed on a bottom surface of the reference plate, to adjust light irradiation angles of the light emitting elements to the photosensitive elements by adjusting degrees of screwing of the screw members into the screw holes.

According to the invention, it is possible to easily align the N head substrates and the N photosensitive elements at high accuracy, and in assembling the image forming apparatus, an operation of positional adjustment can be simplified. That is, since directions of the N head substrates can be individually changed using the screw members, even if mounting positions of the head substrates to the reference plate or positions of the photosensitive elements slightly deviate in assembling the image forming apparatus, irradiating positions of light from the light emitting elements can be easily adjusted by adjusting the degree of screwing the screw members after the assembling. Consequently, it becomes possible to obtain satisfactory color images free of pixel misalignment.

This invention provides an image forming apparatus comprising:

exposing means having N head substrates (N is a natural number of 2 or more) mounted on a reference plate which is disposed on a support and provided with light emitting element arrays, the exposing means being mounted on the reference plate so that the light emitting element arrays are aligned nearly in parallel with each other; and N photosensitive elements on which electrostatic latent images are formed by receiving light from each light emitting element of the exposing means, wherein a plurality of thickness adjusting members are disposed between the reference plate and the head substrates, and light irradiation angles of the light emitting elements to the photosensitive elements are adjusted by varying thicknesses of the thickness adjusting members.

According to the invention, the same as in the case where the screw members are used, it is possible to easily align the N head substrates and the N photosensitive drums at high accuracy, and it is possible to simplify the operation of positional adjustment in assembling the image forming apparatus. That is, since it is possible to change directions of the N head substrates individually by the thickness adjusting members, even if the locations of the head substrates to the reference plate or positions of the photosensitive elements slightly deviate in assembling the image forming apparatus, positions irradiated with light from the light emitting elements can be easily adjusted by adjusting thicknesses of the thickness adjusting members after the assembling. Consequently, it becomes possible to obtain good-quality color images free of pixel displacement.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
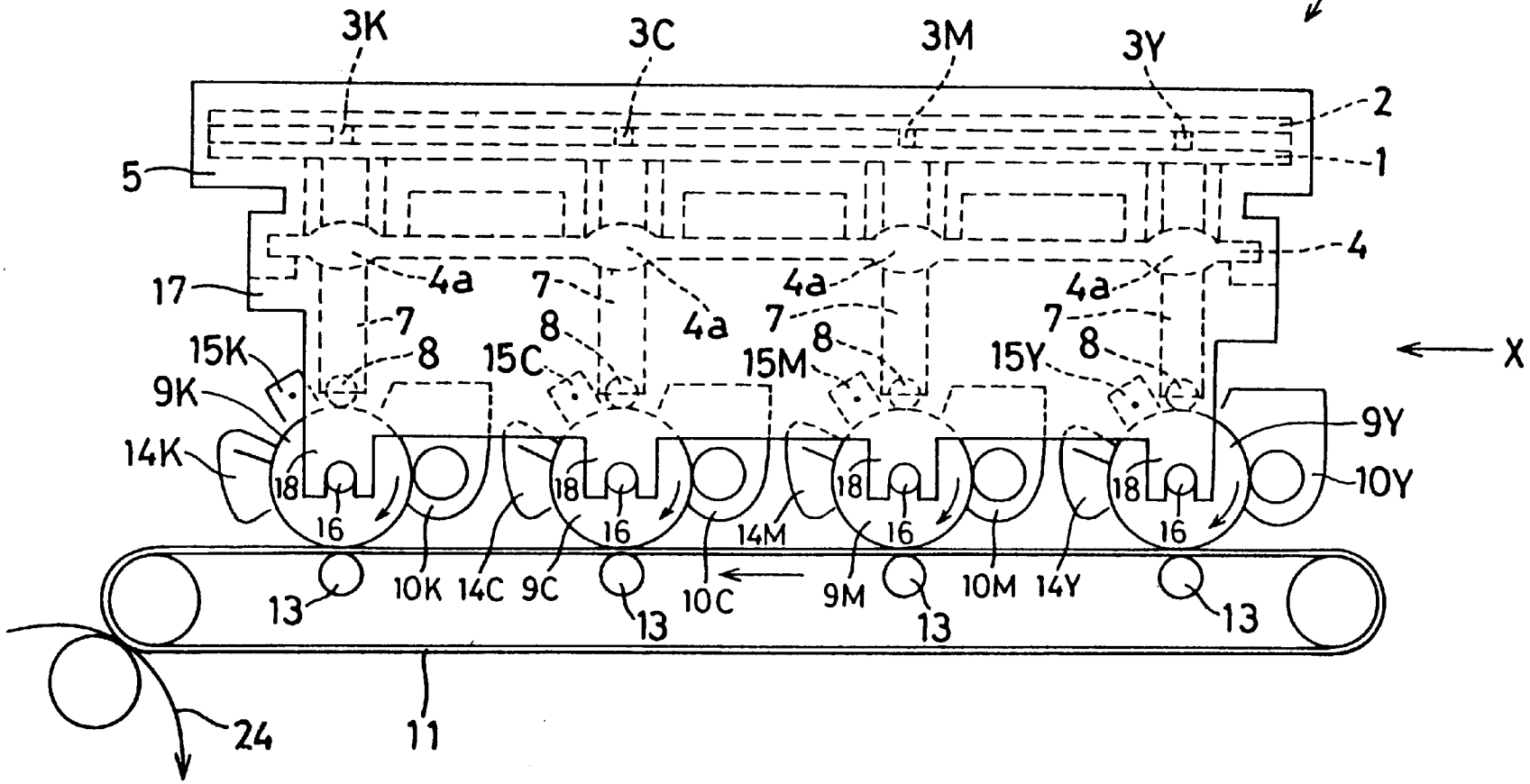
FIG. 1 is a side view schematically showing an image forming apparatus 19 of a first embodiment of the invention.

Now referring to the drawings, preferred embodiments of the invention are described below.

Figure 2:
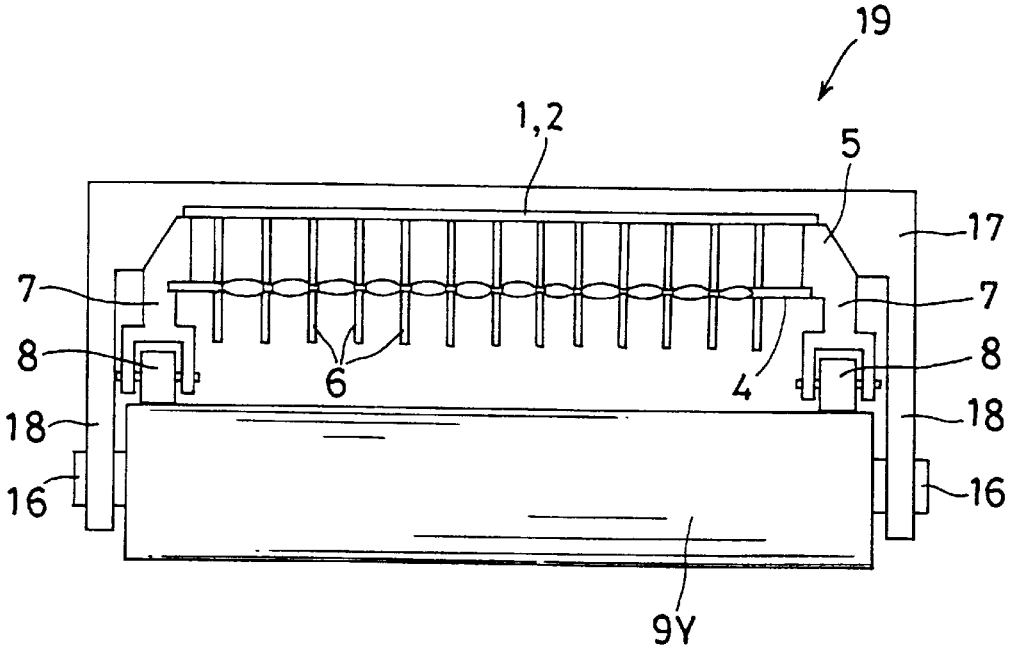
FIG. 2 is a front view of FIG. 1 as seen from X direction.

FIG. 1 is a side view showing an image forming apparatus 19 of a first embodiment of the invention, while FIG. 2 is a front view of FIG. 1 as seen from X direction. The image forming apparatus 19 is an apparatus adopting a tandem system for forming four color images of Y, M, C, and K, and generally, comprises, for example, a circuit substrate 1 on an anode side on which four light emitting element arrays 3Y, 3M, 3C, 3k are mounted, a circuit, substrate 2 on a cathode side, a lens array 4, a first holder 5, four photosensitive drums 9Y, 9M, 9C, 9K, four developing device 10Y, 10M, 10C, 10K, a transferring belt 11, four cleaners 14Y, 14M, 14C, 14K, four chargers 15Y, 15M, 15C, 15K, and a second holder 17.

Each of the light emitting element arrays 3Y, 3M, 3C, 3K is constituted, for example, by a plurality of LED array chips arranged in a row composed of a plurality of LED elements arranged in a straight line, and driven by color image signals for each color. On a single circuit substrate 1 are mounted light emitting element arrays 3Y, 3M, 3C, 3K at specified intervals in parallel with each other. For example, the interval between adjacent light emitting element arrays is selected to be within a range of 50 mm to 100 mm, and the length of the circuit substrate 1 in a direction of arrangement of the four light emitting element arrays, namely, along a right to left direction in the sheet of FIG. 1 is generally selected to be within arange from 200 mm to 400 mm. On the circuit substrate 1 is mounted a circuit substrate 2 so as to sandwich the light emitting element arrays 3Y, 3M, 3C, 3K between the circuit substrates 1 and 2.

The light from the light emitting element arrays 3Y, 3M, 3C, 3K is irradiated towards the photosensitive drums 9Y, 9M, 9C, 9K, respectively, via the lens array 4. The lens array 4 includes, for example, a plurality of lenses 4*a* arranged on optical axes of the LED elements and these lenses 4*a* are integrally formed to construct the lens array 4. The lens array 4 is not limited to the ones constructed by integrally forming the lenses 4*a*, but may be composed of individual lenses.

The circuit substrates 1, 2 and lens array 4 are held by the first holder 5. Now, the position is aligned in such a manner that the direction of light irradiation of the light emitting element arrays 3Y, 3M, 3C, 3K nearly coincide with the optical axis direction of the lens 4*a* of the lens array 4. The first holder 5 has a partition board 6 for shielding light from adjacent LED element, and a spacer 7 provided with a roller 8 contacting with a photosensitive drum at a tip end thereof for every LED array 3Y, 3M, 3C, 3K as shown in FIG. 2. With this spacer 7, the intervals between each of the light emitting element arrays 3Y, 3M, 3C, 3K and the photosensitive drums 9Y, 9M, 9C, 9K can be held nearly constant.

Each of the photosensitive drums 9Y, 9M, 9C, 9K is thus constructed that a cylindrical substrate surface is covered with a photosensitive layer of amorphous silicon or the like, and on the peripheral surface of the photosensitive drum is established an electrostatic latent image forming position where electrostatic latent images are formed by receiving light from each of the light emitting element arrays 3Y, 3M, 3C, 3K, The diameter of each of the photosensitive drums 9Y, 9M, 9C, 9K is selected to be, for example, within a range of 16 mm to 30 mm.

On peripheral portions of the photosensitive drums 9Y, 9M, 9C, 9K are arranged the developing devices 10Y, 10M, 10C, 10K, the transferring belt 11, the cleaners 14Y, 14M, 14C, 14K and the chargers 15Y, 15M, 15C, 15K, respectively, in sequence towards the downstream side of the rotation direction assuming that each electrostatic latent image forming position is a reference. The transferring belt 11 is provided in common for the four photosensitive drums 9Y, 9M, 9C, 9K.

The photosensitive drums 9Y, 9M, 9C, 9K are held by the second holder 17. The second holder 17, specifically, has four engaging pieces 18 each of which engaging with a rotating shaft 16 of each of the photosensitive drums 9Y, 9N, 9C, 9K. The second holder 17 is fixed to the first holder 5. Now, position is aligned in such a manner that the direction of rotating shaft of each photosensitive drums 9Y, 9M, 9C, 9K nearly coincides with the arrangement direction of the LED elements of each of the light emitting element arrays 3Y, 3M, 3C, 3K.

By the way, the first holder 5 and the second holder 17 may be integrally formed. Such holders 5, 17 are desirable to be achieved with materials, for example, whose thermal expansion coefficient ranges from $-5\times10^{-6}$ to $10\times10^{-6}$.

Figure 3:
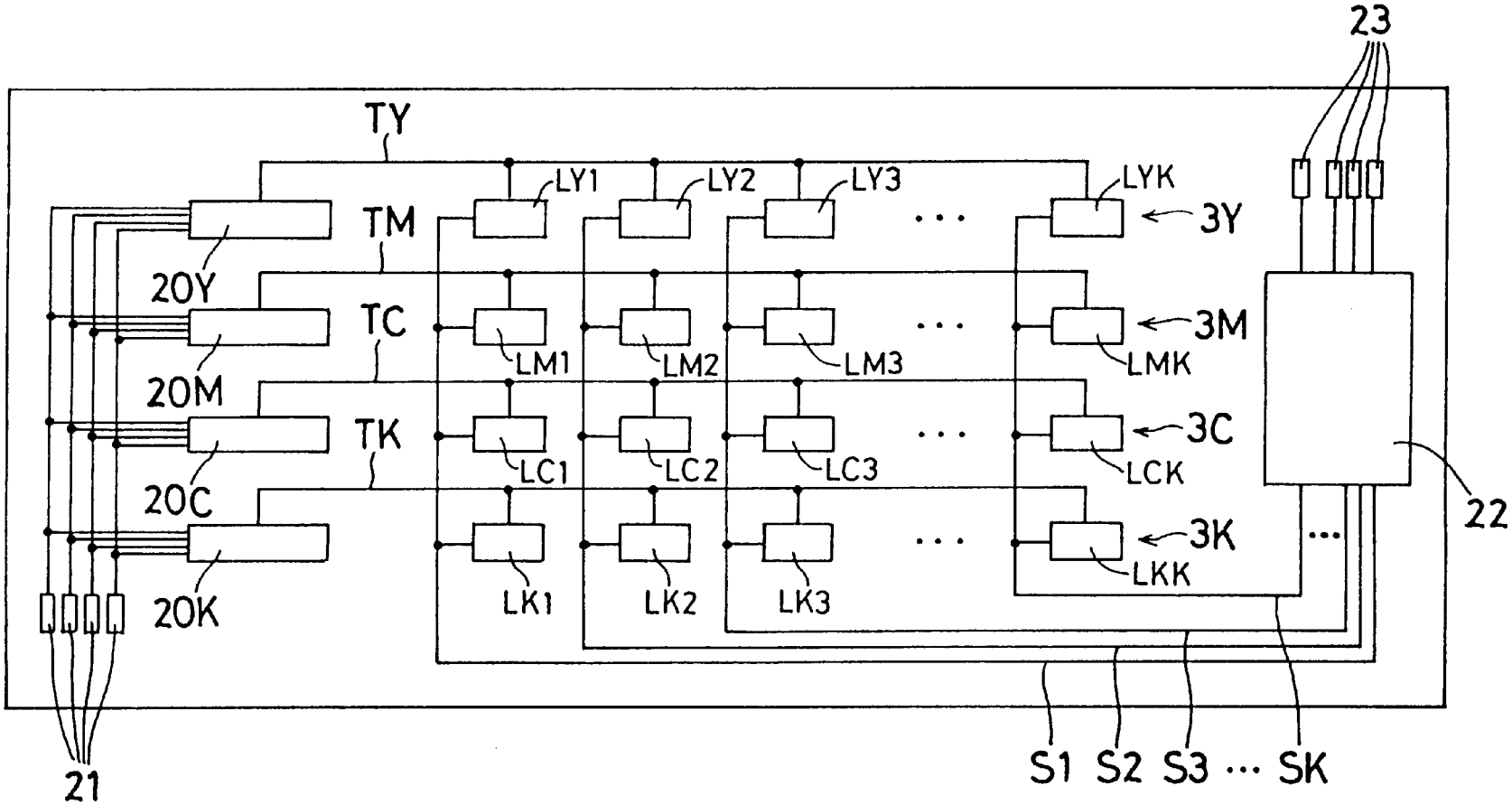
FIG. 3 is a circuit diagram showing an electrical configuration for driving light emitting element arrays 3Y, 3M, 3C, and 3K of the image forming apparatus 19.

FIG. 3 is a circuit diagram showing an electrical configuration for driving each of the light emitting element arrays 3Y, 3M, 3C, 3K of the image forming apparatus 19. The LED elements of first to fourth light emitting element arrays 3Y, 3M, 3C, 3K of four colors are classified into K groups (K is a natural number), respectively, so that one group is simultaneously driven. Specifically, because each of the light emitting element arrays 3Y, 3M, 3C, 3K is formed with a plurality of LED array chips having a specified number of LED elements, for example, 64 LED elements, each light emitting element array is formed with, for example, K LED array chips and are classified into K groups for a certain LED array chip.

That is, the first light emitting element array 3Y is classified into LED array chips LY1, LY2, . . . , LYK, and the second to the fourth light emitting element arrays 3M, 3C, 3K are classified similarly into LED array chips LM1, LM2, . . . , LMK; LC1, LC2, . . . , LCK; LK1, LK2, . . . , LKK, respectively.

The LED array chips LY1 to LYK, LM1 to LMK, LC1 to LCK, and LK1 to LKK of the first through the fourth light emitting element arrays 3Y, 3M, 3C, 3K are chosen in the time-sharing manner by four anode side drive circuits 20Y, 20M, 20C, 20K and single cathode side drive circuit 22, and driven.

The drive circuit 20Y is connected to each of the LED array chips LY1 to LYK of the first light emitting element array 3Y by the anode side signal wiring TY, the drive circuit 20M is connected to each of the LED array chips LM1 to LMK of the second light emitting element array 3M by the anode side signal wiring TM, the drive circuit 20C is connected to each of the LED array chips LC1 to LCK of the third light emitting element array 3C by the anode side signal wiring TC, and the drive circuit 20K is connected to each of the LED array chips LK1 to LKK of the fourth light emitting element array 3K by the anode side signal wiring TK. The drive circuits 20Y, 20M, 20C, 20K are connected to an I/O terminal 21, respectively.

Each of the first LED array chips LY1, LM1, LC1, LK1 of the first through fourth light emitting element arrays 3Y, 3M, 3C, 3K are connected to the drive circuit 22 in common by the cathode side signal wiring S1, the second LED array chips LY2, LM2, LC2, LK2 are connected to the drive circuit 22 in common by the cathode side signal wiring S2, and in the similar manner, the Kth LED array chips LYK, LMK, LCK, LKK are connected to the drive circuit 22 in common by the cathode side signal wiring SK. To the drive circuit 22, an I/O terminal 23 is connected.

By choosing the first through fourth light emitting element arrays 3Y, 3M, 3C, 3K by drive circuits 20Y, 20M, 20C, 20K to give a color image signal of each color and successively choosing signal wiring from S1 to SK by the drive circuit 22, LED array chips LY1 to LYK, LM1 to LMK, LC1 to LCK, and LK1 to LKK can be chosen in the time-sharing manner and dynamically driven.

By the way, in FIG. 3, component elements on the anode side and the cathode side are shown together on one paper, but each of the light emitting element arrays 3Y, 3M, 3C, 3K, the drive circuits 20Y, 20M, 20C, 20K, the I/O terminal 21, and the signal wiring TY, TM, TC, TK are mounted on the anode side circuit substrate 1, and the drive circuit 22, the I/O terminal 23, and the signal wiring S1 through SK are mounted on the cathode side circuit substrate 2. The I/O terminals 21, 23 may be arranged in a row at one place.

In addition, it is not necessarily limited to classify K LED array chips into K groups of one LED array chip and it is allowed to classify the K LED array chips into groups of a plurality of LED array chips.

The color image is formed in order of Y, M, C, K, and first of all, on the peripheral surface of the photosensitive drum 9Y electrically charged by the charger 15Y, light from the first light emitting element array 3Y controlled as described above is irradiated to form an electrostatic latent image. The electrostatic latent image is developed with toner of Y by the developing device 10Y, and a toner image is formed. The toner image is transferred to the transferring belt 11 brought in contact with the photosensitive drum 9Y by the roller 13.

Then, on the peripheral surface of the photosensitive drum 9M electrically charged by the charger 15M, light from the first light emitting element array 3M controlled as described above is irradiated to form an electrostatic latent image. The electrostatic latent image is developed with the toner of M by the developing device 10M, and a toner image is formed. The toner image is transferred to the transferring belt 11. Toner images of C and K are also transferred to the transferring belt 11 in the same manner. The toner image transferred to the transferring belt 11 is further transferred and fixed to the specified recording paper 24, and a color image is formed.

Upon completion of transferring, an excess toner adhering to the photosensitive drums 9Y, 9M, 9C, 9K is removed by the cleaner 14Y, 14M, 14C, 14K, and is again electrically charged by the chargers 15Y, 15M, 1SC, 15K.

As described above, according to the first embodiment, because four light emitting element arrays 3Y, 3M, 3C, 3K are mounted on the single circuit substrate 1, it is possible to easily and highly accurately positioning among the light emitting element arrays 3Y, 3M, 3C, 3K with the circuit pattern used as a reference. Consequently, the position of this kind of light emitting element arrays and other component elements may be aligned using the spacer 7 or the holder 17, and the operation of positional adjustment can be simplified. In additions the use of the single circuit substrate on which four light emitting element arrays are mounted can improve the commercial productivity, and the image forming apparatus 19 can be achieved at low cost.

Because four light emitting element arrays 3Y, 3M, 3C, 3K are mounted on the single circuit substrate 1, it is possible to provide the drive circuit 22 of a group selecting circuit in common, and with this configuration, it is possible to simultaneously choose the light emitting elements of first to fourth light emitting element arrays 3Y, 3M, 3C, 3K for every group, for example, the first LED array chips LY1, LM1, LC1, LK1, the second LED array chips LY2, LM2, LC2, LK2, . . . Consequently, as against four drive circuits 22 are required in the conventional technique, in this embodiment, drive can become possible with a single drive circuit 22, and the size and the cost of the image forming apparatus 19 can be reduced. And the control for choosing LED array chips can be easily carried out en bloc.

In the first embodiment, an example in which the cathode side drive circuit 22 is used in common is explained, but in the similar manner, it is allowed to use the anode side drive circuits 20Y, 20M, 20C, 20K in common to further reduce size and the cost, and control easily.

For a second embodiment of the invention, it is possible to form the surface of the single circuit substrate 1 on which the four light emitting element arrays 3Y, 3M, 3C, 3K are mounted, into a form of circular arc. For example, the circuit substrate 1 may be realized by a flexible substrate formed of borosilicate glass or polyimide and having a thickness of about 50 $\mu$m, and after mounting the LED array chips, the circuit substrate 1 may be bent in a circular arc form.

It is possible to arrange the lens array 4 and photosensitive drums 9Y, 9M, 9C, 9K along the circular-arc form circuit substrate using this kind of circuit substrate, and holding each component element with the first and the second holders 5, 17. For example, it is possible to arrange each component element radically so as to provide such a configuration that the light is directly irradiated outwards. In addition, by arranging the transferring belt 11 in such a manner to come in contact with the four photosensitive drums 9Y, 9M, 9C, 9K, it is possible to reduce the size of the image forming apparatus 19 without reducing the intervals between the photosensitive drums 9Y, 9M, 9C, 9K.

Figure 4:
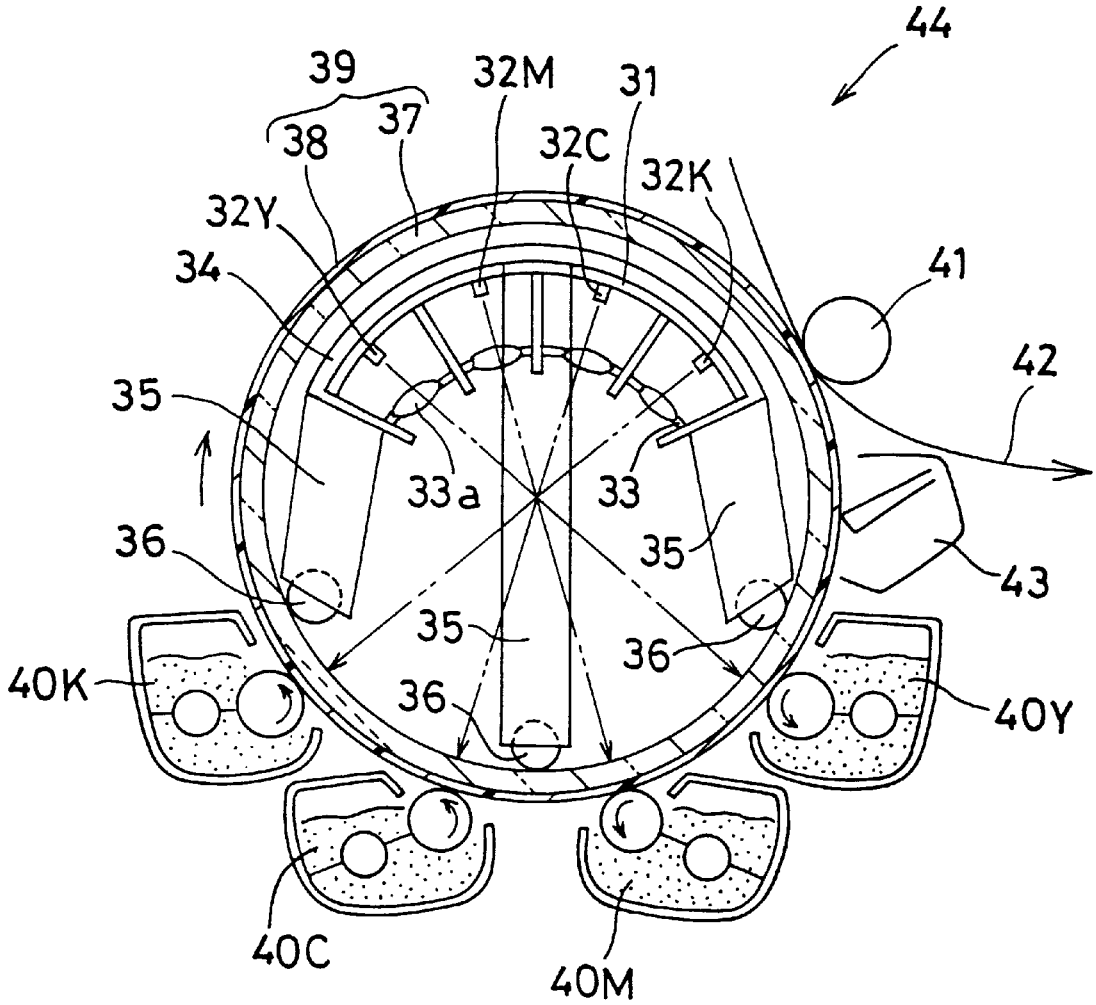
FIG. 4 is a side view showing an image forming apparatus 44 of a third embodiment of the invention.

FIG. 4 is a side view showing an image forming apparatus 44 of a third embodiment of the invention. The image forming apparatus 44 of this embodiment is also an apparatus adopting the tandem system for forming four color images of Y, M, C, K, and generally comprises, for example, a circuit substrate 31 on which four light emitting element arrays 32Y, 32M, 32C, 32K are mounted, a lens array 33, a holder 34, a single photosensitive drum 39, four developing devices 40Y, 40M, 40C, 40K, a transferring roller 41, and a cleaner 43.

The single photosensitive drum 39 is formed by coating the surface of a transparent cylinder 37 with a photosensitive layer 38, and on a peripheral surface of the photosensitive drum 39, four electrostatic latent image forming positions are established, where electrostatic latent images are formed by receiving light from each of the light emitting element array 32Y, 32M, 32C, 32K arranged inside the photosensitive drum 39 in a manner described later. Each of the developing device 40Y, 40M, 40C, 40K is so arranged that the toner may be supplied to the position where the light from each of the light emitting element arrays 32Y, 32M, 32C, 32K reaches the photosensitive drum 39, that is, to each of the electrostatic latent image forming positions. In the rotating direction downstream from the developing devices 40Y, 40M, 40C, 40K, aspecified recording paper 42 is brought in contact with the photosensitive drum 39 by the transferring roller 41, and further downstream, the cleaner 43 is arranged.

Each of the light emitting element arrays 32Y, 32M, 32C, 32K arranged inside the photosensitive drum 39 have a plurality of LED elements arranged in a straight line as is the case of the first embodiment, and is driven by color image signals of each color. To the single circuit substrate 31, each of the light emitting element arrays 32Y, 32M, 32C, 32K are arranged at specified intervals parallel with each other, and the circuit substrate constitutes an anode side circuit substrate. Though it is not illustrated, to the circuit substrate 31, as is the case of the first embodiment, the cathode side circuit substrate is arranged with the light emitting element arrays 32Y, 32M, 32C, 32K sandwiched therebetween.

The circuit substrate 31 has the surface formed in an circular arc as described in the second embodiment. However, the surface of this embodiment is formed in a circular arc curved on the side opposite to that of the second embodiment, and the light from each of the light emitting element arrays 32Y, 32M, 32C, 32K once goes to the inner side of the photosensitive drum 39, and then is irradiated towards outside.

The light from each of the light emitting arrays 32Y, 32M, 32C, 32K is irradiated towards the photosensitive drum 39, respectively, via the lens array 33. The lens array 33 is configured by integrally forming a plurality of lenses 33*a* in the similar manner as is the case of the lens array 4, but may be configured with individual lenses. The lens array 43 is formed bent along the surface of the circuit substrate 31.

The circuit substrate 31 and the lens array 33 are held by the holder 34. Now the position is aligned in such a manner that the light irradiating direction of the light emitting element arrays 32Y, 32M, 32C, 32K nearly coincides with the optical axis direction of the lens 33*a* of the lens array 33. The holder 34 is arranged extending towards the photosensitive drum 39, in the vertical direction in this embodiment, and has a spacer 35 equipped with a roller 36 in contact with the photosensitive drum 39 at the tip end. With the spacer 35, it is possible to hold the intervals between each of the light emitting element arrays 32Y, 32M, 32C, 32K and the photosensitive drum 39 nearly constant.

Color images are formed in order of Y, M, C, K, and first of all, light from the first light emitting element array 32Y controlled in the similar manner as in the case of the first embodiment is applied to the first electrostatic latent image forming position on the peripheral surface of the electrically charged photosensitive drum 39 and an electrostatic latent image is formed. The electrostatic latent image is developed with the toner of Y by the developing device 40Y and a toner image is formed.

Then, on the second electrostatic latent image forming position on the peripheral surface of the photosensitive drum 39, the light from the second light emitting element array 32M is applied from the back surface and an electrostatic latent image is formed, and the image is developed with the toner of M by the developing device 40M, and a toner image is formed. In the same manner, C and K toner images are formed. The Y, M, C, K toner images are transferred and fixed to the specified recording paper 42 brought in contact by the transferring roller 41, and the color image is formed. After completion of transferring, an excess toner adhering to the photosensitive drum 39 is removed by the cleaner 43.

As described above, according to the third embodiment. because four light emitting element arrays 32Y, 32M, 32C, 32K are arranged on the single circuit substrate 31, positioning of light emitting element arrays 32Y, 32M, 32C, 32K can be easily and highly accurately carried out as is the case of the first embodiment, and the operation of positional adjustment can be simplified. In addition, commercial productivity can be improved and an image forming apparatus 44 can be achieved at low cost.

In addition, because inside the single photosensitive drum 39, four light emitting element arrays 32Y, 32M, 32C, 32K are arranged, it is possible to arrange four developing devices 40Y, 40M, 40C, 40K around the single photosensitive drum 39 and thereby achieving still smaller image forming apparatus 44.

By the way, the surface of the circuit substrate 31 arranged inside the photosensitive drum 39 of the third embodiment may be curved as described in the second embodiment so that the light can be irradiated immediately outwards, and even configuring in this way can reduce the size of the image forming apparatus.

Figure 5:
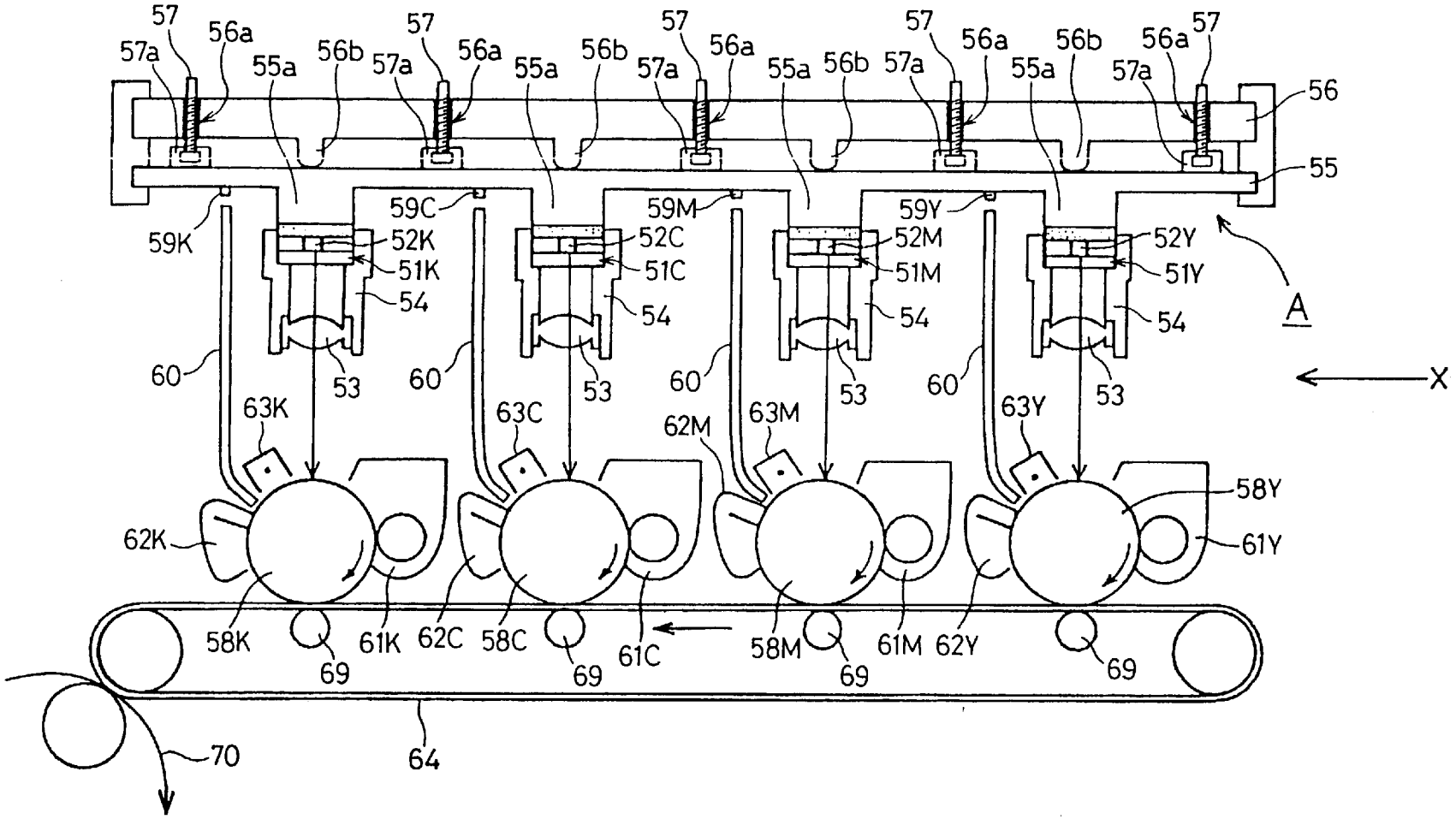
FIG. 5 is a side view of an image forming apparatus of a fourth embodiment of the invention.
Figure 6:
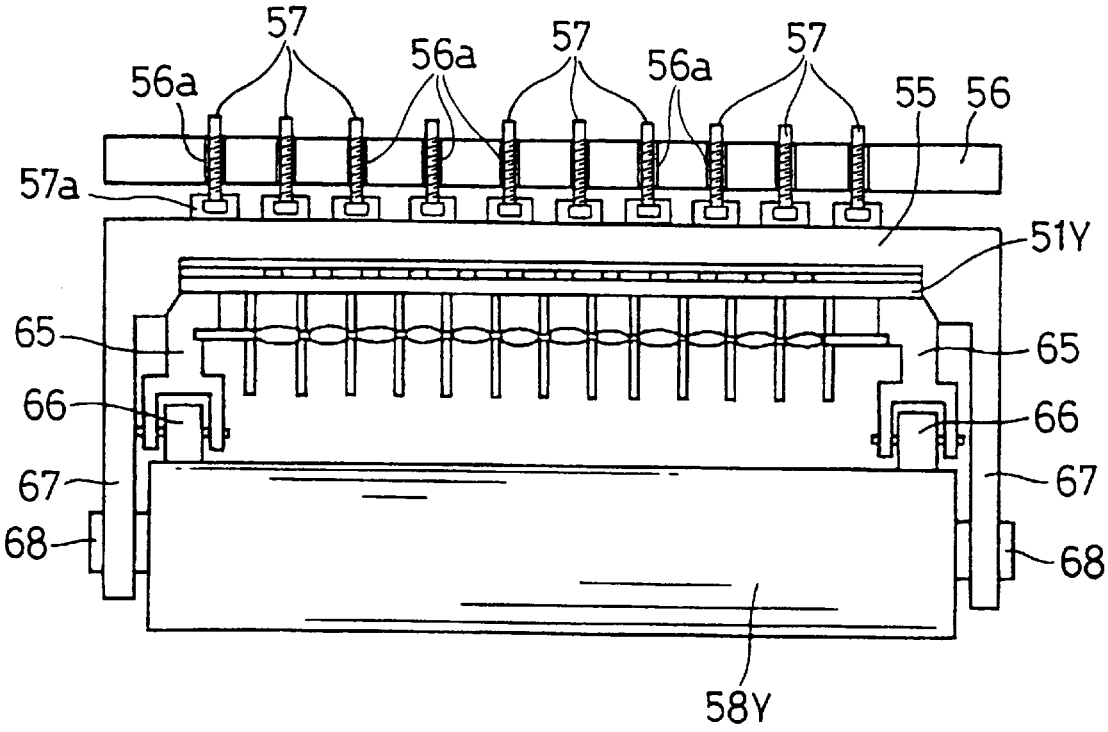
FIG. 6 is a front view of the image forming apparatus of FIG. 5 as seen from X direction.
Figure 7:
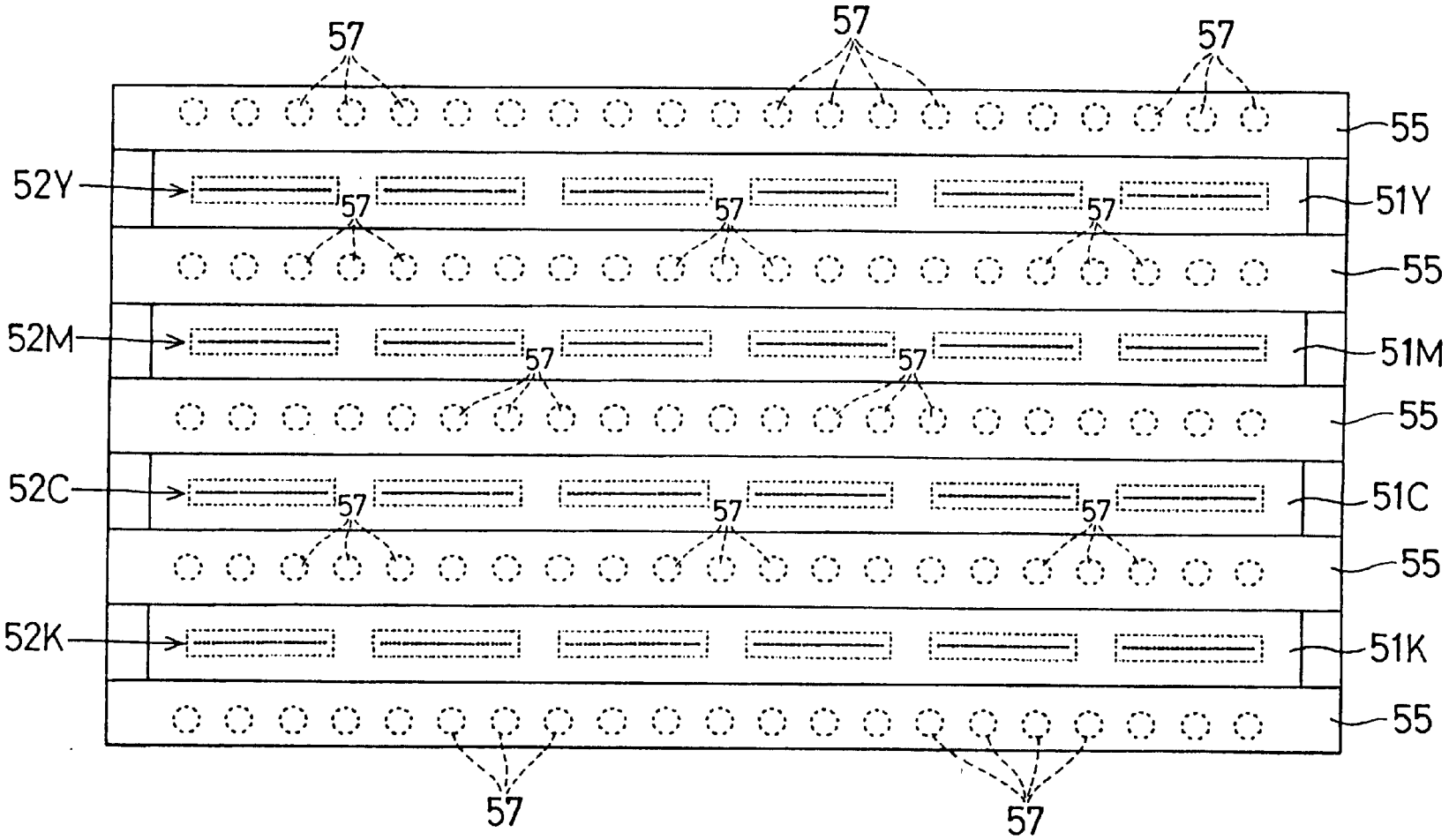
FIG. 7 is a plan showing one example of the exposing means used for the image forming apparatus of FIG. 5.

FIG. 5 is a side view showing an image forming apparatus of a fourth embodiment according to the invention, FIG. 6 is a front view of FIG. 5 as seen from the X direction, and FIG. 7 is a plan view showing one example of the exposing means used for the image forming apparatus of FIG. 5. The image forming apparatus shown in FIG. 5 through FIG. 7 is the apparatus adopting the tandem system for forming four color images of Y, M, C, K.

The image forming apparatus generally comprises an exposing means A including four head substrates 51Y, 51M, 51C, 51K on which four light emitting element arrays 52Y, 52M, 52C, 53K are individually arranged, four lens members 53, four holders 54, a single reference plate 55, a single support 56 equipped with a screw hole 56*a* and a screw member 57, four photosensitive drums 58Y, 58M, 58C, 58K, four erasers 59Y, 59M, 59C, 59K, four light conducting members 60 for guiding light from the eraser to each photosensitive drum, four developing devices 61Y, 61M, 61C, 61K, four cleaners 62Y, 62M, 62C, 62K, four chargers 63Y, 63M, 63C, 63K, and a transferring belt 64.

Each of the light emitting element arrays 52Y, 52M, 52C, 52K of the four head substrates 51Y, 51M, 51C, 51K comprises, for example, by arranging in a row a plurality of LED array chips each comprising a plurality of LED elements arranged in a straight line, and are driven based on the color image signals of each color. Each of the head substrates 51Y, 51M, 51C, 51K comprises, for example, by grasping each of light emitting element arrays 52Y, 52M, 52C, 52K between two circuit substrates. Four head substrates 51Y, 51M, 51C, 51K are mounted, respectively, to one single reference plate 55 having a specified flexibility in such a manner that the light emitting element arrays 52Y, 52M, 52C, 52K are arranged in the specified intervals nearly in parallel with each other.

The reference plate 55 is equipped to facilitate installation of the four head substrates 51Y, 51M, 51C, 51K to the image forming apparatus by allowing the four head substrates 51Y, 51M, 51C, 51K to be fixed in common. With this configuration, it is possible to position en bloc the four head substrates 51Y, 51M, 51C, 51K to each of the photosensitive drums 58Y, 58M, 58C, 58K later described. This kind of reference plate 55 is formed, for example, by metal such as aluminum, etc., resin such as liquid crystal polymer, etc., and glass, etc. In the case the plate 55 is formed with aluminum, it is formed to have a thickness of 2 mm to 7 mm. To the portion to which each of the head substrates 51Y, 51N, 51C, 51K is mounted, a convex portion 55*a* having a thickness of 5 mm to 50 mm is provided, respectively. In this event, same as in the first embodiment, intervals of adjacent light emitting element arrays are chosen to be 50 mm to 100 mm, and the length of the reference plate 55 along the direction in which the four light emitting element arrays are arranged, that is, along the right and left direction in the paper of FIG. 5 is generally chosen to be 200 mm to 400 mm.

The light from each of the light emitting element arrays 52Y, 52M, 52C, 52K is irradiated towards each of the photosensitive drums 58Y, 58M, 58C, 58K via each lens member 53. For the lens member 53, for example, a plurality of nonspherical single lenses each being in a one-to-one correspondence with a plurality of LED array chips composing the light emitting element array are used. Each of lens members 53 is held to head substrates 51Y, 51M, 51C, 51K by each of holders 54, and positioned so that the light irradiating direction of light emitting element arrays 52Y, 52M, 52C, 52K nearly coincides with the optical axis direction of the corresponding lens member 53.

At the back opposite to the lens member 53 of the reference plate 55 to which the four head substrates 51Y, 51M, 51C, 51K are mounted, the support 56 is arranged. The support 56 is designed to fix the reference plate 55 to a specified portion in the image forming apparatus so as to hold the distance between each of the head substrates 51Y, 51M, 51C, 51K mounted to the reference plate 55 and each of the photosensitive drums 58Y, 58M, 58C, 58K constant, and is made from the material with lower flexibility than the reference plate 55, for example, from SUS, etc having a thickness of 5 mm to 10 mm.

The support 56 has the screw hole 56*a* formed in the thickness direction thereof. The screw hole 56*a* is formed at the position on both sides of each of head substrates 51Y, 51M, 51C, 51K in the direction intersecting at right angles the four light emitting element arrays 52Y, 52M, 52C, 52K, specifically, at the center position between adjacent head substrates. To this screw hole 56*a*, the screw member 57 mounted to the bottom surface of the reference plate 55, that is, the surface opposite to the lens member 53 of the reference plate 55 is screwed.

Figure 8:
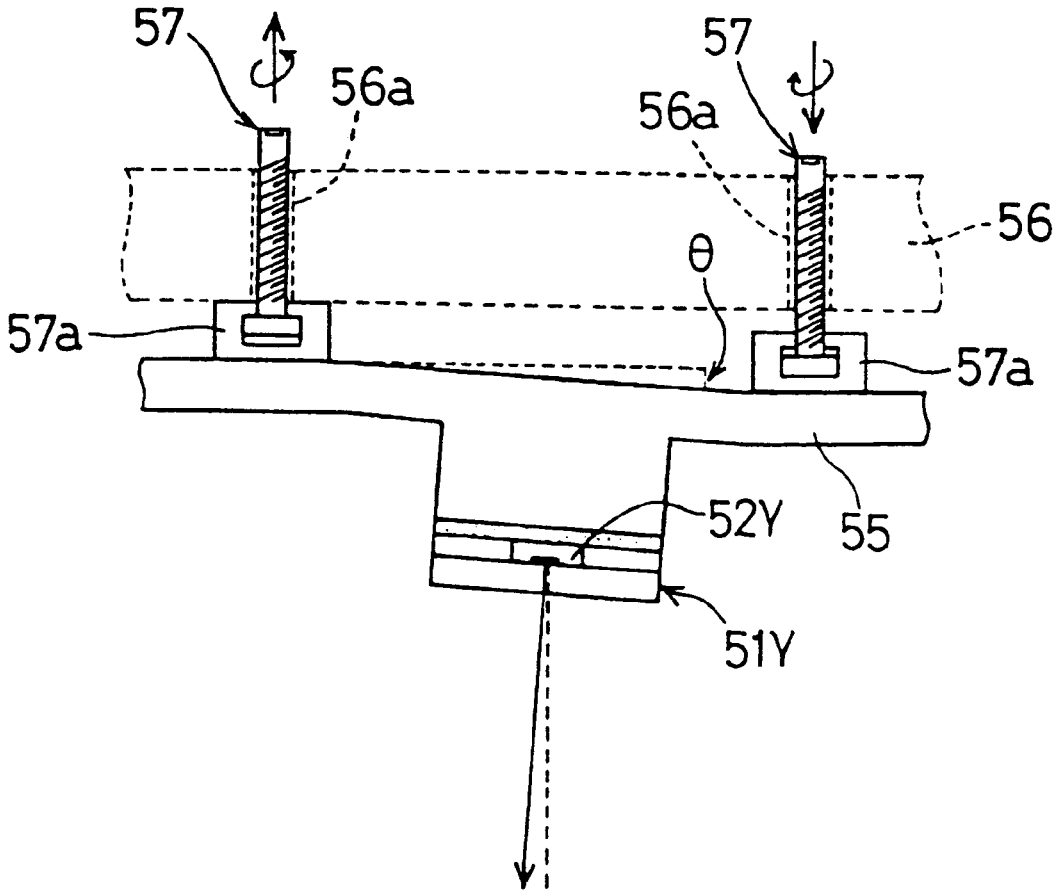
FIG. 8 is a side view for explaining an operation of adjusting the direction of a head substrate.

As shown in FIG. 8, by adjusting the degree of screwing the screw member 57 into the screw hole 56*a*, the irradiation angle of the light from the light emitting element of each of the head substrates 51Y, 51M, 51C, 51K is adjusted. The screw member 57 is mounted to the reference plate 55 by engaging the tip end thereof with the latching member 57*a* fixed to the bottom surface of the reference plate 55.

For example, in the case the distance between adjacent screw members 57 is L and the direction of the head substrate is to be tilted by angle θ, the reference plate 55 with flexibility is tilted allowed to approach or kept apart on both sides of the head substrate with respect to the support 56 by adjusting in such a manner that one screw member 57 is screwed by L·tan θ deeper or L·tan θ shallower than the other screw member 57.

Carrying out this kind of angle adjustment enables individual fine adjustment of mounting angle of each of the head substrates 51Y, 51M, 51C, 51K even after the head substrates have been mounted to the reference plate 55. Consequently, in the case the fixing position of the head substrate to the reference plate 55 or mounting position of the photosensitive drum slightly deviates when an image forming apparatus is assembled, adjusting the screwing degree of each screw member 57 as described above enables simple correction of the light irradiation position from the light emitting element and can effectively prevent generation of pixel misalignment.

By the way, the support 56 has a protrusion 56*b* in contact with the reference plate 55 between adjacent screw members 57, and with this protrusion 56*b*, it is possible to cope with the case where the focal distance of each head varies.

On both ends of the reference plate 55 related to the length direction (right and left direction in FIG. 6) of each head substrate described above, a pair of spacers 65 with a roller 66 at the tip end are fixed as is the case of the first embodiment, and by bringing the roller 66 of the spacer 65 into contact with the photosensitive drums 58Y, 58M, 58C, 58K, the distance between each of the light emitting element arrays 52Y, 52M, 52C, 52K and each of the photosensitive drums 58Y, 58M, 58C, 58K is designed to be held constant.

Each of the photosensitive drums 58Y, 58M, 58C, 58K is formed in the same manner as is the case of the photosensitive drums 9Y, 9M, 9C, 9K of the first embodiment, and the electrostatic latent image forming position is established, and the diameter is chosen to be, for example, 16 mm to 30 mm. Around each of the photosensitive drums 58Y, 58M, 58C, 58K, successively towards the downstream side of the rotating direction with each of the electrostatic latent image forming position as reference, the developing devices 61Y, 61M, 61C, 61K, the transferring belt 64, the cleaners 62Y, 62M, 62C, 62K, the erasers 59Y, 59M, 59C, 59K, and the chargers 63Y, 63M, 63C, 63K are arranged, respectively, and the transferring belt 64 is provided in common for the four photosensitive drums 58Y, 58M, 58C, 58K.

Each of the photosensitive drums 58Y, 58M, 58C, 58K is held by the holder 67. The holder 67 is, specifically, formed integral with the reference plate 55 of the above-mentioned exposing means A, and is designed to engage with the rotating shaft 68 of each of the photosensitive drums 58Y, 58M, 58C, 58K. Now, the position is aligned in such a manner that the rotating direction of each of photosensitive drums 58Y, 58M, 58C, 58K nearly coincide with the arranging direction of LED elements of each of the light emitting element arrays 52Y, 52M, 52C, 52K. By the way, the holder 67 is desirable to be achieved with the material whose thermal expansion coefficient ranges from $-5\times10^{-6}$ to $10\times10^{-6}$.

The color images are formed in order of Y, M, C, K as is the case of the first embodiment. First of all, on the outer surface of the photosensitive drum 58Y charged by the charger 63Y, light from the light emitting element array 52Y is irradiated based on the Y color image signal, and an electrostatic latent image is formed. This electrostatic latent image is developed with the Y toner by the developing device 61Y, and the specified toner image is formed. This toner image is transferred to the transferring belt 64 in contact with the photosensitive drum 58Y via the roller 69. Next, on the outer surface of the photosensitive drum 58M charged by the charger 63M, an electrostatic latent image is formed with the light from the light emitting element array 52M based on the M color image signal, and transferred to the transferring belt 64. In this same manner, C and K toner images are transferred to the transferring belt 64, and these toner images are further transferred and fixed to a specified recording paper 70 and a color image is formed.

As described above, according to the image forming apparatus of the fourth embodiment, because four head substrates 51Y, 51M, 51C, 51K are designed to be fixed to the single reference plate 55, it is possible to simply and highly accurately align the head substrates 51Y, 51M, 51C, 51K to the photosensitive drums 58Y, 58M, 58C, 58K by the use of the spacer 65, etc., and the operation of positional adjustment becomes simplified in assembling the image forming apparatus.

In addition, because the reference plate 55 has the specified flexibility and the tilting angle of each head substrate can be varied by bringing the substrate plate 55 closer to or away from the support 56 by the screw member 57 fixed to the position between adjacent head substrates, in the case the fixing position of the head substrate to the reference plate 55 or the position of the photosensitive drum may slightly deviate when the image forming apparatus is assembled, the light irradiation angle from the light emitting element can be simply corrected by adjusting the screwing degree of each screw member 57, and it becomes possible to form satisfactory color images free of pixel misalignment.

Figure 9:
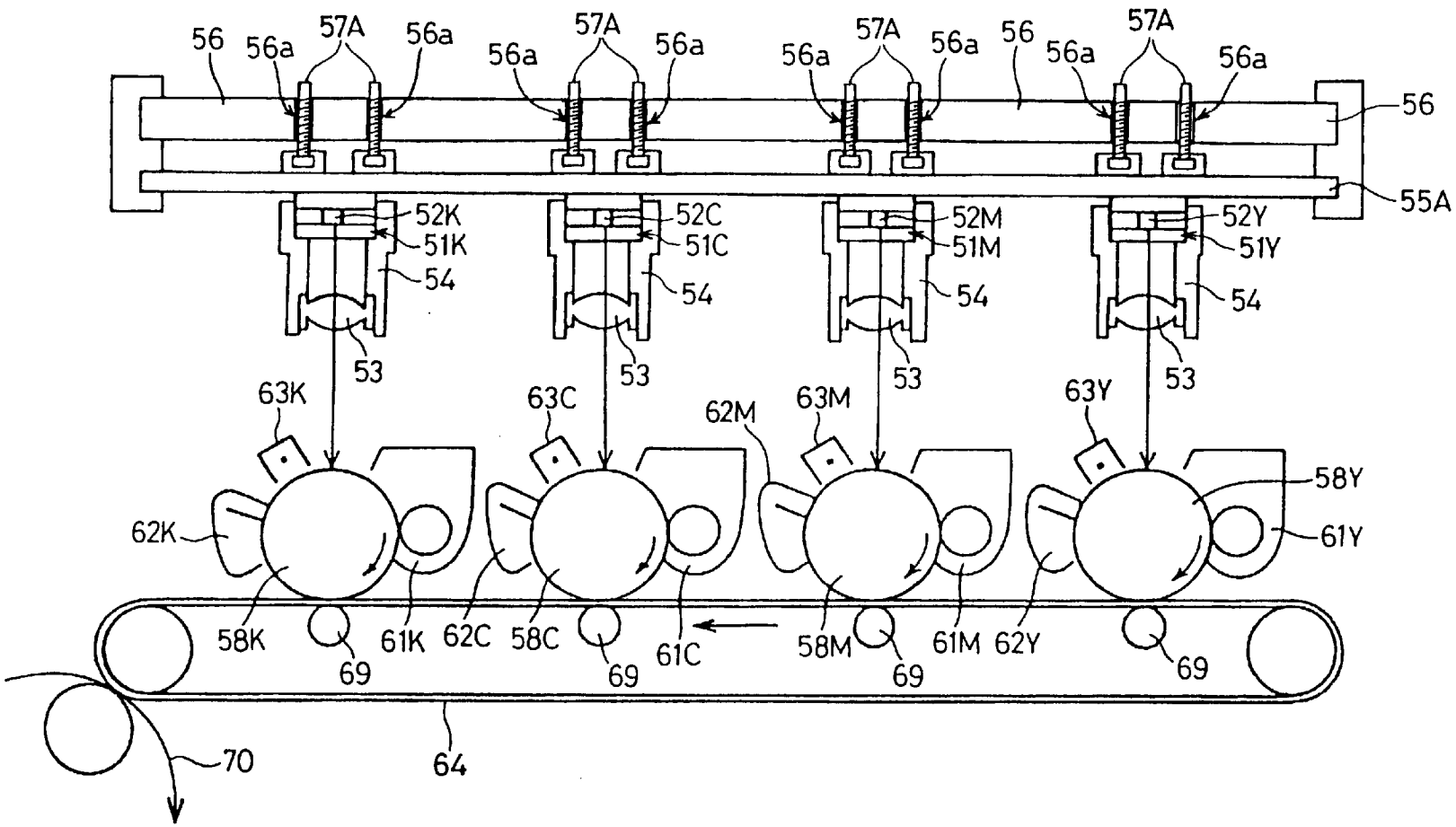
FIG. 9 is a side view of an image forming apparatus of a fifth embodiment of the invention.

Now, description is made on a fifth embodiment of the invention. For the same or corresponding component elements found in the fourth embodiment, the same reference characters are designated, and redundant description will be omitted. FIG. 9 is a side view of an image forming apparatus according to the fifth embodiment of the invention. The image forming apparatus shown in FIG. 9 uses a reference plate 55A in place of the reference plate 55. As is the case of the fourth embodiment, four head substrates 51Y, 51M, 51C, 51K to which light emitting element arrays 52Y, 52M, 52C, 52K are provided, respectively, are mounted on the flat reference plate 55A so that each of the light emitting element arrays is arranged nearly in parallel. In the thickness direction of the support 56 arranged on the back of the reference plate 55A, the screw hole 56*a* is provided in the vicinity of both end portions of each of the head substrates 51Y, 51M, 51C. 51K related to the arrangement direction of the head substrates, and by screwing the screw member 57A secured to the bottom surface of the reference plate 55A to the screw hole 56*a* of the support 56, the reference plate 55A is arranged on the support 56. On one main surface of the reference plate 55A, a positioning marker is provided, and to this marker, four corners of each of the head substrates 51Y, 51M, 51C, 51K are aligned.

Even in the image forming apparatus of the fifth embodiment, by adjusting the screwing degree of the screw member 57A to the screw hole 56*a*, the light irradiation angle from the light emitting element of each of the head substrates 51Y, 51M, 51C, 51K can be adjusted, and as is the case of the fourth embodiment, each of the head substrates 51Y, 51M, 51C, 51K and each of the photosensitive drums 58Y, 58M, 58C, 58K can be aligned highly accurately and simply using the spacer 65, etc., and the operation of positional adjustment can be simplified in assembling the image forming apparatus.

Figure 10:
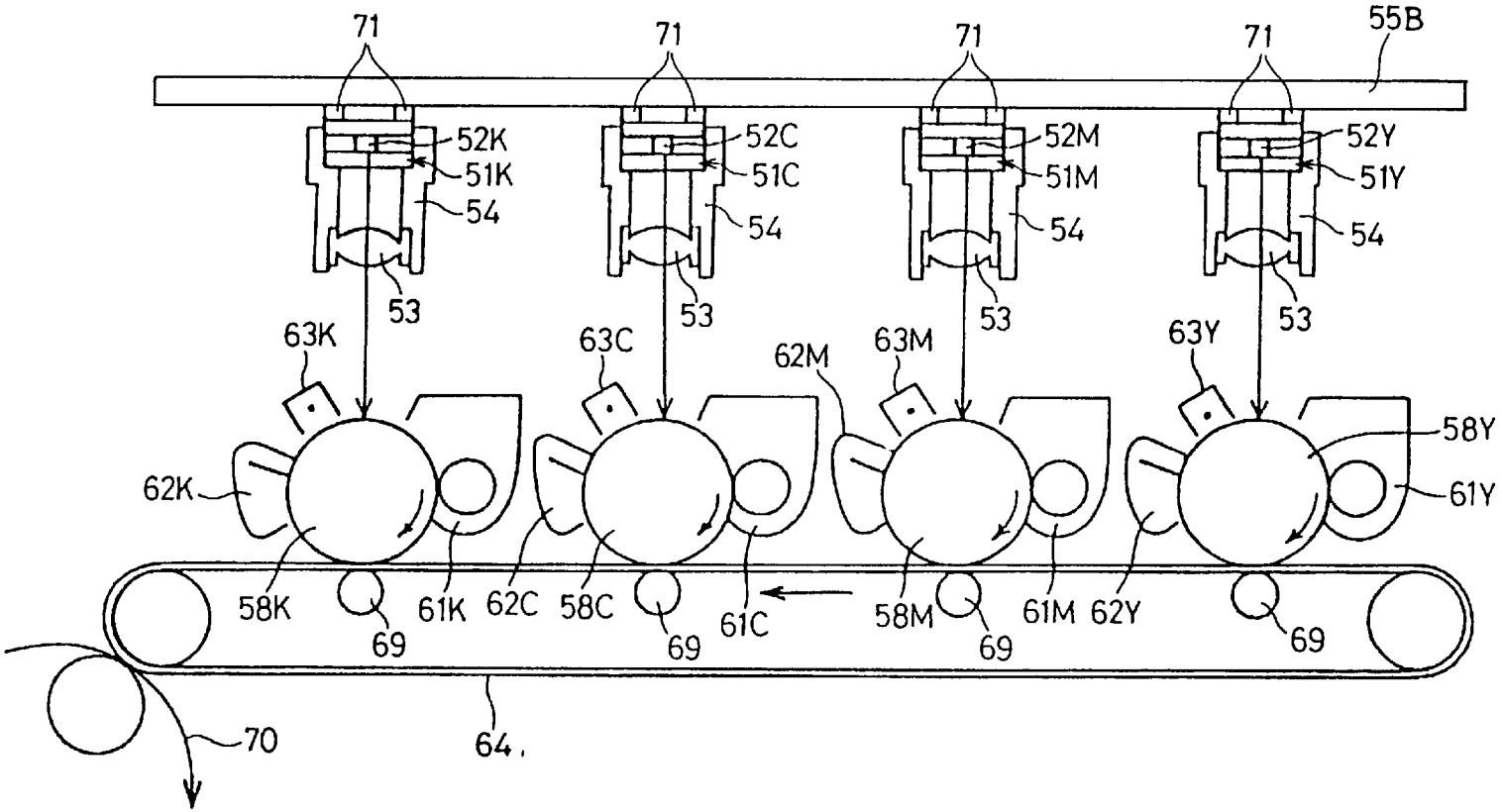
FIG. 10 is a side view of an image forming apparatus of a sixth embodiment according to the invention.

Next description will be made on a sixth embodiment according to the invention. For the same or corresponding component elements found in the fourth embodiment, the same reference characters are designated, and redundant description will be omitted. FIG. 10 is a side view of an image forming apparatus according to the sixth embodiment of the invention. The image forming apparatus shown in FIG. 10 is designed to use a thickness adjusting member 71, and as is the case of the fourth embodiment, the four head substrates 51Y, 51M, 51C, 51K to which the light emitting element arrays 52Y, 52M, 52C, 52K are provided, respectively, are mounted on a flat reference plate 55B in such a manner that each of the light emitting element arrays are arranged nearly in parallel. In addition, between the head substrates 51Y, 51M, 51C, 51K and the reference plate 55B, the thickness adjusting member 71 are designed to be intervened in the vicinity of both end portions of each of the head substrates 51Y, 51M, 51C, 51K related to the arrangement direction of the head substrate.

For the thickness adjusting member 71, BIMORPH type piezoelectric element, hollow pipe, cam, etc. are used. For example, in the case a BIMORPH type piezoelectric element is adopted, the thickness of the piezoelectric element is varied by adjusting the electric power applied to each element. Or in the case a hollow pipe is adopted, air or oil is injected into the pipe and the injection amount is adjusted to vary the pipe outside profile. It is possible to adjust the light irradiation angle from the light emitting element of each of the head substrates 51Y, 51M, 51C, 51K by interposing this kind of thickness adjusting member 71 between the head substrates 51Y, 51M, 51C, 51K and the reference plate 55B.

In the image forming apparatus of the sixth embodiment as well, by varying the thickness of the thickness adjusting member 71, the light irradiation angle from the light emitting elements of each of the head substrates 51Y, 51M, 51C, 51K can be adjusted, and as is the case of the fourth embodiment in which the screw member 57 is used and the fifth embodiment in which the screw member 57A is used, the operation of positional adjustment can be simplified in assembling the image forming apparatus.

In the first through sixth embodiments, examples of forming four color images of Y, M, C, K are explained, but the color images are not lmited to four colors and examples to form color images of N colors by N color image signals (N is a natural number equal to 2 or more) are also included in the scope of the invention.

In the sixth embodiment, on the surface of the reference plate 55B, a recess portion is provided, and in this recess portion, a BIMORPH type piezoelectric element, a hollow pipe, a cam, etc. used for the thickness adjusting member 71 may be embedded.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

N light emitting element arrays (N is a natural number of 2 or more) each composed of a plurality of light emitting elements arranged in a straight line in a first direction; and N photosensitive elements each receiving light from one of the light emitting element arrays whereby electrostatic latent images are formed, wherein the N light emitting element arrays are mounted on one substrate parallel to each other and spaced apart in a second direction substantially perpendicular to the first direction at specified intervals.

2. The image forming apparatus of claim 1, wherein a surface of the substrate on which the light emitting element arrays are mounted is curved.

3. An image forming apparatus comprising:

a photosensitive drum formed by covering a photosensitive layer around a peripheral surface of a transparent cylinder;

N light emitting element arrays (N is a natural number of 2 or more) arranged inside the photosensitive drum and each composed of a plurality of light emitting elements arranged in a straight line; and N developing devices for supplying color toner to the peripheral surface of the photosensitive drum, wherein the light emitting element arrays are mounted on one substrate having a curved surface at specified intervals in parallel with each other, and the developing devices are disposed so that the color toner is supplied to positions of the photosensitive drum to which lights from the light emitting element arrays reach.

4. The image forming apparatus of any one of claims 1 to 3, wherein the light emitting elements of each of the N light emitting element arrays are classified into K groups (K is a natural number); a group selecting circuit for selecting one from among the groups of light emitting elements of each light emitting element array in the time-sharing manner, and K pieces of group selecting wiring are disposed on the substrate; and the light emitting elements of the N light emitting element arrays are connected in common by group via the K pieces of group selecting wiring.

5. An image forming apparatus comprising:

exposing means having N head substrates (N is a natural number of 2 or more) mounted on a reference plate which is disposed on a support and provided with light emitting element arrays, the exposing means being mounted on the reference plate so that the light emitting element arrays are aligned nearly in parallel with each other; and N photosensitive elements on which electrostatic latent images are formed by receiving light from each light emitting element of the exposing means, wherein screw holes are provided on the support and screw members for screwing into the screw holes are formed on a bottom surface of the reference plate, to adjust light irradiation angles of the light emitting elements to the photosensitive elements by adjusting degrees of screwing of the screw members into the screw holes.

6. An image forming apparatus comprising:

exposing means having N head substrates (N is a natural number of 2 or more) mounted on a reference plate which is disposed on a support and provided with light emitting element arrays, the exposing means being mounted on the reference plate so that the light emitting element arrays are aligned nearly in parallel with each other; and N photosensitive elements on which electrostatic latent images are formed by receiving light from each light emitting element of the exposing means, wherein a plurality of thickness adjusting members are disposed between the reference plate and the head substrates, and light irradiation angles of the light emitting elements to the photosensitive elements are adjusted by varying thicknesses of the thickness adjusting members.

* * * * *